US011649138B2

(12) United States Patent
Kwon et al.

(10) Patent No.: US 11,649,138 B2
(45) Date of Patent: May 16, 2023

(54) ELEVATOR SYSTEM MONITORING AND CONTROL BASED ON HOISTWAY WIND SPEED

(71) Applicant: OTIS ELEVATOR COMPANY, Farmington, CT (US)

(72) Inventors: Yisug Kwon, Farmington, CT (US); Daniel Pahng, Unionville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 454 days.

(21) Appl. No.: 16/864,740

(22) Filed: May 1, 2020

(65) Prior Publication Data

US 2021/0339982 A1 Nov. 4, 2021

(51) Int. Cl.
*B66B 5/02* (2006.01)
*B66B 5/00* (2006.01)

(52) U.S. Cl.
CPC ..... *B66B 5/022* (2013.01); *B66B 5/0031* (2013.01)

(58) Field of Classification Search
CPC ..... B66B 5/022; B66B 5/02; B66B 1/3492; B66B 5/0018; B66B 5/00; B66B 3/02; B66B 5/021; B66B 1/285; B66B 11/0045; B66B 11/028; B66B 11/08; B66B 5/0006; B66B 5/04
See application file for complete search history.

(56) References Cited

U.S. PATENT DOCUMENTS 4,056,169 A * 11/1977 Showalter ..... B66B 5/022 187/278
2020/0239274 A1* 7/2020 Gurvich ..... B66B 1/3476

FOREIGN PATENT DOCUMENTS

| | | | | |
|---|---|---|---|---|
| CN | 108466894 A | * | 8/2018 | |
| CN | 108483170 A | * | 9/2018 | |
| CN | 108483171 A | * | 9/2018 | |
| CN | 108706416 A | * | 10/2018 | |
| CN | 108792875 A | * | 11/2018 | |
| CN | 108821052 A | * | 11/2018 | |
| CN | 109095337 A | * | 12/2018 | |
| CN | 110015602 A | * | 7/2019 | ..... B66B 1/06 |
| EP | 3693315 B1 | * | 4/2022 | ..... B66B 1/06 |
| FI | 123182 B | * | 12/2012 | |
| JP | 5642240 B1 | * | 12/2014 | ..... B66B 5/00 |
| JP | 2016172642 A | * | 9/2016 | ..... B66B 5/0018 |
| JP | 2020063127 A | * | 4/2020 | |
| JP | 2020083582 A | * | 6/2020 | ..... B66B 1/30 |
| KR | 20080036005 A | * | 4/2008 | |
| WO | WO-03076323 A1 | * | 9/2003 | ..... B66B 5/022 |
| WO | WO-2007013434 A1 | * | 2/2007 | ..... B66B 5/022 |
| WO | WO-2007067491 A2 | * | 6/2007 | ..... B66B 5/022 |
| WO | WO-2008079145 A1 | * | 7/2008 | ..... B66B 7/06 |

(Continued)

*Primary Examiner* — Marlon T Fletcher
(74) *Attorney, Agent, or Firm* — Carlson, Gaskey & Olds, P.C.

(57) ABSTRACT

An illustrative example embodiment of an elevator system monitoring assembly includes a wind detector configured to detect wind in a hoistway and to provide a wind detector output regarding the detected wind. A processor is configured to receive the wind detector output, determine whether at least one characteristic of the detected wind satisfies at least one predetermined criterion corresponding to an effect on the elevator system, and provide an indication of at least one of the satisfied criterion and the effect on the elevator system.

20 Claims, 2 Drawing Sheets

(56) References Cited

FOREIGN PATENT DOCUMENTS

| | | | | | |
|---|---|---|---|---|---|
| WO | WO-2013184085 | A1 * | 12/2013 | ..... | B66B 1/28 |
| WO | WO-2016208394 | A1 * | 12/2016 | ..... | B66B 1/28 |
| WO | WO-2017085839 | A1 * | 5/2017 | ..... | B66B 5/02 |
| WO | WO-2018150786 | A1 * | 8/2018 | ..... | B66B 1/32 |

* cited by examiner

ELEVATOR SYSTEM MONITORING AND CONTROL BASED ON HOISTWAY WIND SPEED

BACKGROUND

Elevator systems are useful for carrying passengers and items between different levels of a building. Many elevator systems are traction-based and include traction ropes that suspend the elevator car and a counterweight. A machine causes movement of a traction sheave that, in turn, causes movement of the traction ropes for moving the elevator car as desired. One feature of traction-based elevator systems is a compensation assembly including compensation ropes suspended beneath the car and counterweight and a tie down mechanism near the bottom of the hoistway. The compensation assembly facilitates maintaining appropriate tension on the traction ropes to achieve desired traction.

Certain conditions may develop that introduce or cause the ropes to sway or move laterally from side to side. Rope sway is problematic. At a minimum, rope sway introduces vibration and hinders ride quality. In some situations, the rope sway can be extensive enough to cause the swaying ropes to contact other system components or the hoistway walls, which can damage those components or the ropes. High rise buildings are particularly susceptible to rope sway because of the extensive length of the ropes.

A variety of rope sway mitigation proposals have been made but none of them adequately address hoistway wind as a potential cause of rope sway.

SUMMARY

An illustrative example embodiment of an elevator system monitoring assembly includes a wind detector configured to detect wind in a hoistway and to provide a wind detector output regarding the detected wind. A processor is configured to receive the wind detector output, determine whether at least one characteristic of the detected wind satisfies at least one predetermined criterion corresponding to an effect on the elevator system, and provide an indication of the satisfied criterion, the effect on the elevator system, or both.

In an embodiment having at least one feature of the elevator system monitoring assembly of the previous paragraph, the wind detector comprises an anemometer and the wind detector output indicates a speed of detected wind.

In an embodiment having at least one feature of the elevator system monitoring assembly of any of the previous paragraphs, the wind detector output indicates a frequency of gusts of the detected wind.

In an embodiment having at least one feature of the elevator system monitoring assembly of any of the previous paragraphs, the at least one predetermined criterion comprises a plurality of predetermined criteria; the predetermined criteria comprise a first wind speed threshold, a second wind speed threshold and a third wind speed threshold; the second wind speed threshold is higher than the first wind speed threshold; the third wind speed threshold is higher than the second wind speed threshold; and the processor is configured to determine whether a magnitude of a speed of the detected wind exceeds any of the thresholds.

In an embodiment having at least one feature of the elevator system monitoring assembly of any of the previous paragraphs, the processor indication comprises a first indication that the wind condition requires attention when the magnitude of the speed of the detected wind exceeds the first wind speed threshold, a second indication that the wind condition requires slowing down the elevator system when the magnitude of the speed of the detected wind exceeds the second wind speed threshold, and a third indication that the wind condition requires at least temporarily shutting down the elevator system when the magnitude of the speed of the detected wind exceeds the third wind speed threshold.

In an embodiment having at least one feature of the elevator system monitoring assembly of any of the previous paragraphs, the predetermined criteria comprise at least one threshold frequency, the processor is configured to determine a frequency of gusts of the detected wind based on the wind detector output, and the indication is based on whether the determined frequency of gusts exceeds the threshold frequency.

In an embodiment having at least one feature of the elevator system monitoring assembly of any of the previous paragraphs, the indication provides information regarding the effect on the elevator system based on the speed of the detected wind and the frequency of gusts of the detected wind.

In an embodiment having at least one feature of the elevator system monitoring assembly of any of the previous paragraphs, the effect on the elevator system corresponds to a likelihood that rope sway in the elevator system will result from the detected wind.

In an embodiment having at least one feature of the elevator system monitoring assembly of any of the previous paragraphs, the at least one predetermined criterion comprises at least one threshold frequency, the processor is configured to determine a frequency of gusts of the detected wind based on the wind detector output, and the indication is based on whether the determined frequency of gusts exceeds the threshold frequency.

An illustrative example embodiment of an elevator system includes an elevator car, a counterweight, a plurality of traction ropes suspending the elevator car and the counterweight, a compensation assembly including a plurality of compensation ropes suspended beneath the elevator car and the counterweight, and the monitoring assembly of any of the previous paragraphs.

An illustrative example embodiment of a method includes detecting wind in a hoistway using a wind detector, determining whether at least one characteristic of the detected wind satisfies at least one predetermined criterion corresponding to an effect on an elevator system in the hoistway, and providing an indication of at least one of the satisfied criterion and the effect on the elevator system.

In an embodiment having at least one feature of the method of the previous paragraph, detecting the wind comprises detecting a speed of the detected wind.

In an embodiment having at least one feature of the method of any of the previous paragraphs, detecting the wind comprises detecting a frequency of gusts of the detected wind.

In an embodiment having at least one feature of the method of any of the previous paragraphs, the at least one predetermined criterion comprises a plurality of predetermined criteria; the predetermined criteria comprise a first wind speed threshold, a second wind speed threshold and a third wind speed threshold; the second wind speed threshold is higher than the first wind speed threshold; the third wind speed threshold is higher than the second wind speed threshold; and determining whether at least one characteristic of the detected wind satisfies at least one predetermined criterion comprises determining whether a magnitude of a speed of the detected wind exceeds any of the thresholds.

In an embodiment having at least one feature of the method of any of the previous paragraphs, providing the indication comprises providing a first indication that the wind condition requires attention when the magnitude of the speed of the detected wind exceeds the first wind speed threshold, providing a second indication that the wind condition requires slowing down the elevator system when the magnitude of the speed of the detected wind exceeds the second wind speed threshold, and providing a third indication that the wind condition requires at least temporarily shutting down the elevator system when the magnitude of the speed of the detected wind exceeds the third wind speed threshold.

In an embodiment having at least one feature of the method of any of the previous paragraphs, the predetermined criteria comprise at least one threshold frequency, determining whether at least one characteristic of the detected wind satisfies at least one predetermined criterion comprises determining a frequency of gusts of the detected wind and determining whether the determined frequency exceeds the threshold frequency, and the indication is based on whether the determined frequency of gusts exceeds the threshold frequency.

In an embodiment having at least one feature of the method of any of the previous paragraphs, the indication provides information regarding the effect on the elevator system based on the speed of the detected wind and the frequency of gusts of the detected wind.

In an embodiment having at least one feature of the method of any of the previous paragraphs, the effect on the elevator system corresponds to a likelihood that rope sway in the elevator system will result from the detected wind.

In an embodiment having at least one feature of the method of any of the previous paragraphs, the at least one predetermined criterion comprises at least one threshold frequency, determining whether at least one characteristic of the detected wind satisfies at least one predetermined criterion comprises determining a frequency of gusts of the detected wind and determining whether the determined frequency exceeds the threshold frequency, and the indication is based on whether the determined frequency of gusts exceeds the threshold frequency.

An embodiment having at least one feature of the method of any of the previous paragraphs includes controlling operation of the elevator system based on the provided indication.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention facilitate reducing or minimizing rope sway in an elevator system by monitoring wind in a hoistway and providing an indication of a characteristic of the detected wind, an indication of how the detected wind can affect the elevator system, or both. The indication is useful to control the elevator system in a way that addresses a sway-inducing effect of the wind.

Figure 1:
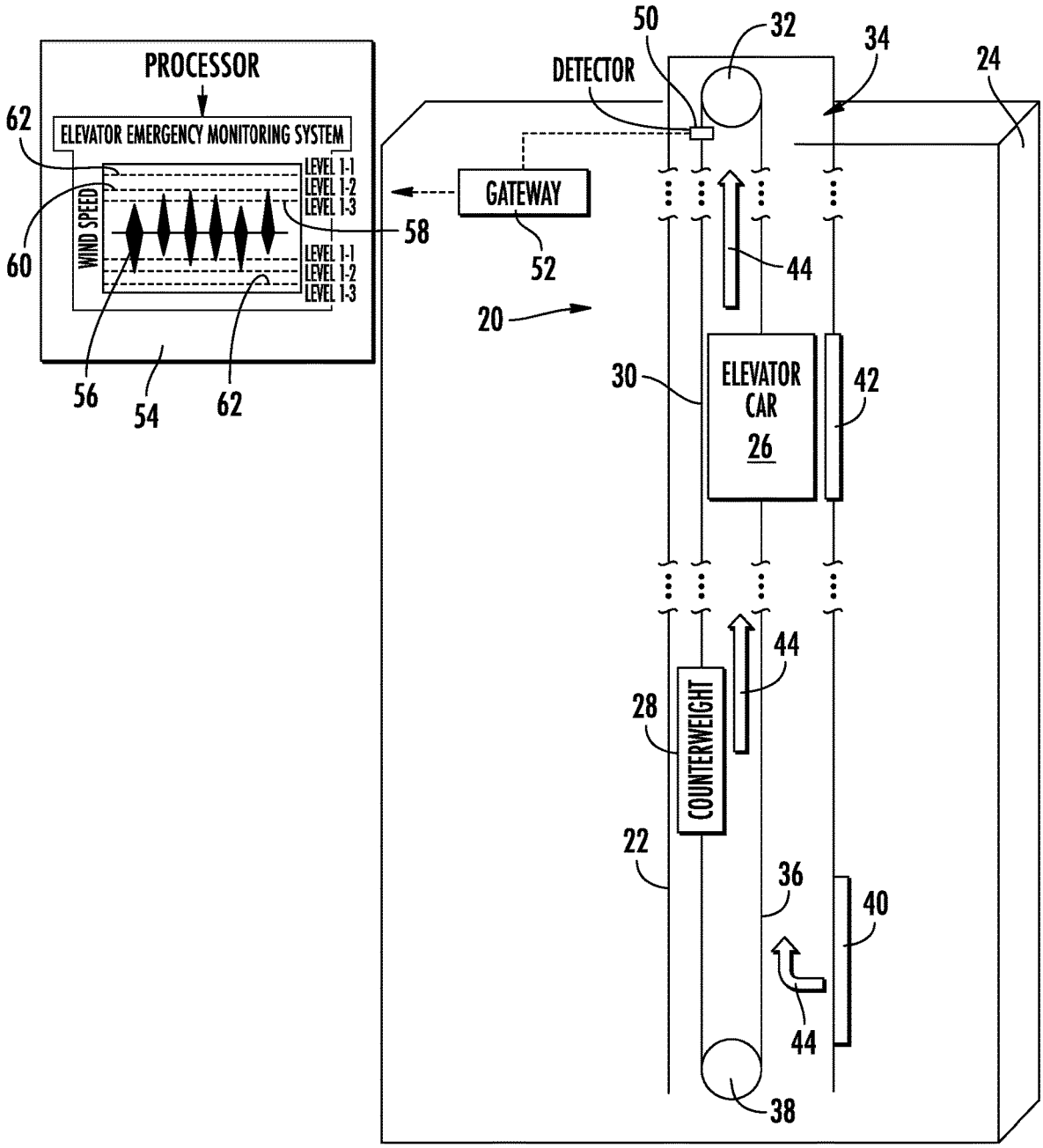
FIG. 1 schematically illustrates selected portions of an example embodiment of an elevator system.

FIG. 1 schematically illustrates selected portions of an elevator system 20 situated within a hoistway 22 in a building 24. An elevator car 26 and a counterweight 28 are suspended by traction ropes 30, such as round steel ropes or flat belts. A machine and traction sheave 32 selectively causes movement of the traction ropes 30 to control the movement and position of the elevator car 26. The machine and traction sheave 32 are located within a machine room 34 in the illustrated example embodiment.

A compensation assembly includes compensation ropes 36 and a tie-down mechanism including a compensation sheave 38. The compensation ropes 36 are suspended beneath the elevator car 26 and the counterweight 28. The compensation assembly facilities maintaining tension on the traction ropes 30 to ensure the desired traction necessary for controlling the movement and position of the elevator car 26.

The hoistway 22 includes a plurality of doors 40, 42 that allow passengers to board or exit the elevator car 26 when the elevator car is at the corresponding landing. In a high rise building there will be many more doors than those which are illustrated for discussion purposes. The hoistway doors 40, 42 introduce a possibility for wind conditions to develop within the hoistway 22 that can have an adverse effect on the elevator system 20. In many tall or high rise buildings, there is a significant temperature difference between the upper portion and lower portion of the hoistway 22. This gives rise to a stack effect or chimney effect and significant upward airflow or wind within the hoistway. For example, when it is cold outside and the door 40 is open, the stack effect results in air moving as schematically shown by the arrows 44 into and toward the top of the hoistway 22. In some situations, such airflow can have a wind speed of up to 30 meters per second (80 miles per hour).

Wind conditions within the hoistway 22 can have a significant effect on the compensation ropes 36, the traction ropes 30 or both. Such rope sway can be problematic. The elevator system 20 includes a monitoring assembly for monitoring wind conditions within the hoistway 22. A wind detector 50 detects air flow or wind within the hoistway 22 and provides an output regarding the detected wind. In the illustrated example embodiment shown in FIG. 1, the detector 50 is situated in the machine room 34 near an opening through which the traction ropes 30 pass as they move between the hoistway 22 and the machine room 34. Some embodiments include at least one wind detector 50 situated within the hoistway 22. Some example embodiments include multiple wind detectors 50 situated in various locations along the hoistway 22.

The detector 50 in the illustrated example embodiment comprises an anemometer. The output of the wind detector 50 in this example indicates a speed of the detected wind. The output of the example detector 50 also indicates a frequency of wind gusts, which is a number of gusts of wind over time.

In the example embodiment of FIG. 1, the wind detector 50 communicates with a gateway 52 that provides the detector output to a processor 54. In some embodiments, the processor 54 is located remotely from the elevator system 20 and the building 24. In other embodiments, the processor 54 is situated within or near the building 24. The processor 54 may be incorporated as part of an elevator controller that controls operation of the elevator system 20 or be a separated computing device as schematically illustrated.

The processor 54 receives the output from the wind detector 50 and determines whether at least one characteristic of the detected wind satisfies at least one predetermined criterion that corresponds to an effect of wind in the hoistway 22 on the elevator system 20. The processor 54 is configured to provide an indication of the satisfied criterion, the effect of detected wind on the elevator system, or both.

In the example embodiment shown in FIG. 1, a plurality of detected gusts of wind 56 are represented by the output from the wind detector 50. The processor 54 determines whether an amplitude or magnitude of any of the detected wind gusts exceeds a first threshold 58, a second threshold 60 or a third threshold 62. The different thresholds correspond to different effects that wind in the hoistway 22 can have on the elevator system 20, such as inducing rope sway in the compensation ropes 36, the traction ropes 30, or both. The processor 54 in this embodiment also determines a frequency of the wind gusts and an amount of time that a detected wind condition exists.

Figure 2:
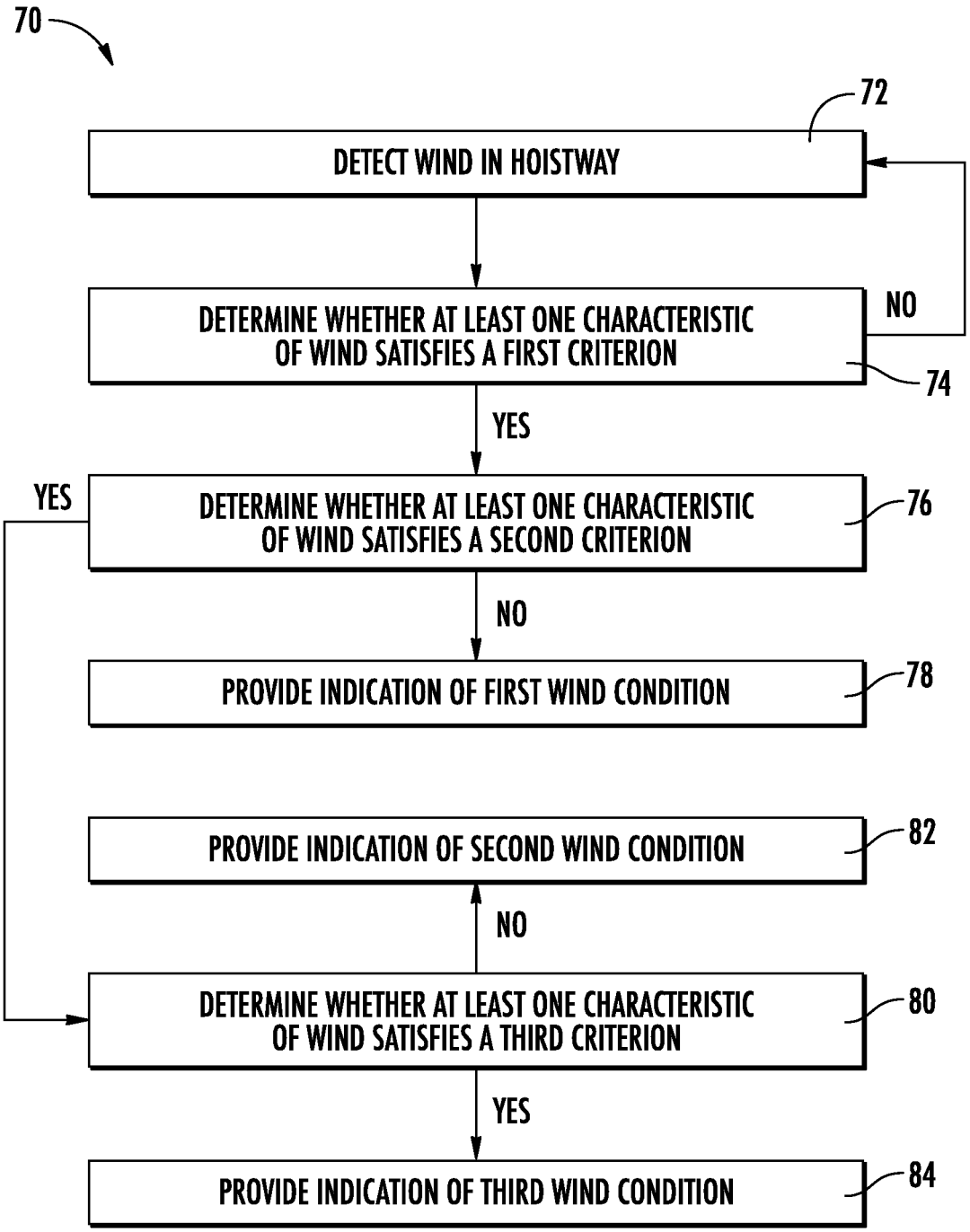
FIG. 2 is a flow chart diagram summarizing an example elevator hoistway wind monitoring method.

FIG. 2 is a flowchart diagram 70 that summarizes an example approach of monitoring and controlling the elevator system 20 based on information regarding wind in the hoistway 22. At 72, the wind detector 50 detects wind in the hoistway 22. At 74, the processor 54 determines whether at least one characteristic of the detected wind satisfies a first criterion. Different characteristics and different criteria may be used in different embodiments.

In an example embodiment, the processor 54 determines whether the wind speed exceeds a first wind speed threshold, such as the threshold 58 shown in FIG. 1. In such embodiments, a first wind speed threshold is the first criterion and the wind speed is the characteristic of interest.

The processor 54 in some embodiments also determines whether a frequency of wind gusts exceeds a frequency threshold, which may be a first frequency threshold when considered as part of the determination made at 74 in FIG. 2.

Some example processors 54 determine an amount of time during which a detected wind condition exists and the first criterion considered at 74 includes a threshold amount of time during which the wind condition exists.

Different combinations of wind speed, frequency and duration may have different effects on the compensation ropes 36, the traction ropes 30, or both. Given this description and the arrangement of a particular elevator system, those skilled in the art will be able to determine an appropriate algorithm to be used by the processor 54 for determining when a wind condition exists in the hoistway 22 that has the potential for inducing rope sway. For example, empirical data can be collected to identify particular wind conditions that induce rope sway in particular buildings or particular elevator system configurations. Such data can be used to develop an appropriate algorithm or decision matrix to be implemented by the processor 54.

If the wind detected at 72 does not satisfy the first criterion at 74, the process continues at 72. When the first criterion is satisfied, the processor 54 determines at 76 whether at least one characteristic of the detected wind satisfies a second criterion. Considering wind speed as an example characteristic of the detected wind, the second criterion corresponds to a second wind speed threshold that is higher than the first wind speed threshold considered at 74. If the detected wind does not satisfy the second criterion at 76, then the processor 54 provides an indication of a first wind condition at 78.

When the detected wind satisfies the second criterion at 76, the processor 54 determines whether at least one characteristic of the wind satisfies a third criterion at 80. For example, the third criterion is a third wind speed threshold that is higher than the second wind speed threshold. When the second criterion was satisfied but the third was not, the processor 54 provides an indication of a second wind condition at 82. In the event that the third criterion is also satisfied, the processor 54 provides an indication of a third wind condition at 84.

Considering the example of FIG. 1, the indication of the first wind condition provided at 78 in FIG. 2 corresponds to the processor 54 determining that the amplitude or magnitude of the detected wind meets or exceeds the first threshold 58. In some embodiments, the indication of a first wind condition having a wind speed exceeding a first wind speed threshold provides information to an elevator service company or an automated elevator monitoring system regarding a condition in the hoistway 22 that requires attention or monitoring because the wind condition is such that it could lead to undesired rope sway.

The indication of a second wind condition provided at 82 in FIG. 2 corresponds to the processor 54 determining that the magnitude or amplitude of the detected wind speed exceeds the second wind speed threshold 60. In some embodiments, the second wind speed threshold 60 corresponds to a wind speed that will cause at least some rope sway. The second indication provides information that the operation of the elevator system 20 should be adjusted, such as slowing down the speed of movement of the elevator car 26 to compensate for the rope sway that is expected based on the detected wind condition. The indication of the second wind condition in some embodiments comprises a command signal that is provided to the drive of the elevator system 20 to slow down operation of the machine and traction sheave 32 and the corresponding speed of the elevator car 26.

In the example embodiment under consideration, the third wind condition indication provided at 84 corresponds to the wind speed exceeding the third wind speed threshold 62. In this example embodiment, when the detected wind speed exceeds the third threshold 62, that corresponds to wind speeds within the hoistway 22 that are high enough to induce an amount of rope sway that requires shutting down the elevator system 20 at least temporarily until the wind subsides. In some embodiments, the indication of the third wind condition includes a command to move the elevator car 26 to a predetermined position within the hoistway 22, which is considered a non-resonant location to avoid a resonant frequency of rope sway, and shutting down the elevator system.

In some embodiments, the criteria considered by the processor 54 are considered in relationship with each other. For example, the wind speed and frequency of wind gusts may satisfy different criteria depending on the combination of those characteristics. A lower wind speed at a higher frequency may have one effect on likely rope sway while a higher wind speed at a lower frequency may have the same effect. The processor 54 in some embodiments is suitably programmed or otherwise configured to take into account multiple criteria and multiple characteristics of the detected wind, such as wind speed, frequency of gusts and wind duration for purposes of determining what type of indication to provide for purposes of controlling the elevator system 20 when that is appropriate or necessary.

For example, a single burst of a relatively high speed wind introduced through the door 40 near a bottom of the hoistway 22 will impact at least the compensation ropes 36. A single impact may have some effect on the compensation ropes 36 without introducing a significant amount of rope sway. Over time, however, with continued exposure to such wind, the compensation ropes 36 may being to sway in a substantial way. Similarly, a number of gusts of such wind over time at certain frequencies will introduce a greater likelihood of undesired rope sway. The processor 54 is configured to utilize an algorithm or decision matrix that includes a variety of combinations of characteristics of the detected wind and to provide an appropriate indication that facilities controlling the elevator system 20 in a manner that reduces or minimizes rope sway or other negative effects that would otherwise result from the detected wind condition in the hoistway 22.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system monitoring assembly, comprising:

a wind detector configured to detect wind in a hoistway within a building and to provide a wind detector output regarding the detected wind, wherein the wind is a result of a chimney effect inside the hoistway; and a processor configured to receive the wind detector output, determine whether at least a frequency of wind gusts of the detected wind satisfies at least one predetermined criterion corresponding to an effect on the elevator system, and provide an indication of at least one of the satisfied criterion and the effect on the elevator system.

2. The elevator system monitoring assembly of claim 1, wherein the wind detector comprises an anemometer and the wind detector output includes an indication of a speed of detected wind.

3. The elevator system monitoring assembly of claim 1, wherein the at least one predetermined criterion comprises a plurality of predetermined criteria;

the predetermined criteria comprise a first wind speed threshold, a second wind speed threshold and a third wind speed threshold;

the second wind speed threshold is higher than the first wind speed threshold;

the third wind speed threshold is higher than the second wind speed threshold; and the processor is configured to determine whether a magnitude of a speed of the detected wind exceeds any of the thresholds.

4. The elevator system monitoring assembly of claim 3, wherein the processor indication comprises a first indication that the wind condition requires attention when the magnitude of the speed of the detected wind exceeds the first wind speed threshold, a second indication that the wind condition requires slowing down the elevator system when the magnitude of the speed of the detected wind exceeds the second wind speed threshold, and a third indication that the wind condition requires at least temporarily shutting down the elevator system when the magnitude of the speed of the detected wind exceeds the third wind speed threshold.

5. The elevator system monitoring assembly of claim 3, wherein the predetermined criteria comprise at least one threshold frequency, the processor is configured to determine the frequency of gusts of the detected wind based on the wind detector output, and the indication is based on whether the determined frequency of gusts exceeds the threshold frequency.

6. The elevator system monitoring assembly of claim 5, wherein the indication provides information regarding the effect on the elevator system based on the speed of the detected wind and the frequency of gusts of the detected wind.

7. The elevator system monitoring assembly of claim 1, wherein the effect on the elevator system corresponds to a likelihood that rope sway in the elevator system will result from the detected wind.

8. The elevator system monitoring assembly of claim 1, wherein the at least one predetermined criterion comprises at least one threshold frequency, the processor is configured to determine the frequency of gusts of the detected wind based on the wind detector output, and the indication is based on whether the determined frequency of gusts exceeds the threshold frequency.

9. An elevator system, comprising:

an elevator car;

a counterweight;

a plurality of traction ropes suspending the elevator car and the counterweight;

a compensation assembly including a plurality of compensation ropes suspended beneath the elevator car and the counterweight; and the monitoring assembly of claim 1.

10. A method comprising:

detecting wind in a hoistway within a building using a wind detector, wherein the wind results from a chimney effect inside the hoistway;

determining whether at least a frequency of gusts of the detected wind satisfies at least one predetermined criterion corresponding to an effect on an elevator system in the hoistway; and providing an indication of at least one of the satisfied criterion and the effect on the elevator system.

11. The method of claim 10, wherein detecting the wind comprises detecting a speed of the detected wind.

12. The method of claim 10, wherein the at least one predetermined criterion comprises a plurality of predetermined criteria;

the predetermined criteria comprise a first wind speed threshold, a second wind speed threshold and a third wind speed threshold;

the second wind speed threshold is higher than the first wind speed threshold;

the third wind speed threshold is higher than the second wind speed threshold; and determining whether at least one characteristic of the detected wind satisfies at least one predetermined criterion comprises determining whether a magnitude of a speed of the detected wind exceeds any of the thresholds.

13. The method of claim 12, wherein providing the indication comprises providing a first indication that the wind condition requires attention when the magnitude of the speed of the detected wind exceeds the first wind speed threshold, providing a second indication that the wind condition requires slowing down the elevator system when the magnitude of the speed of the detected wind exceeds the second wind speed threshold, and providing a third indication that the wind condition requires at least temporarily shutting down the elevator system when the magnitude of the speed of the detected wind exceeds the third wind speed threshold.

14. The method of claim 12, wherein the predetermined criteria comprise at least one threshold frequency, determining whether at least the frequency of the gusts of the detected wind satisfies the at least one predetermined criterion comprises determining whether the frequency of the gusts of the wind exceeds the threshold frequency, and the indication is based on whether the frequency of the gusts of the wind exceeds the threshold frequency.

15. The method of claim 14, wherein the indication provides information regarding the effect on the elevator system based on the speed of the detected wind and the frequency of gusts of the detected wind.

16. The method of claim 10, wherein the effect on the elevator system corresponds to a likelihood that rope sway in the elevator system will result from the detected wind.

17. The method of claim 10, wherein the at least one predetermined criterion comprises at least one threshold frequency, determining whether the frequency of the gusts of the detected wind satisfies at least one predetermined criterion comprises determining whether the determined frequency exceeds the threshold frequency, and the indication is based on whether the determined frequency of gusts exceeds the threshold frequency.

18. The method of claim 10, comprising controlling operation of the elevator system based on the provided indication.

19. An elevator system monitoring assembly, comprising:

a wind detector configured to detect wind in a hoistway and to provide a wind detector output regarding the detected wind; and a processor configured to receive the wind detector output, determine whether at least one characteristic of the detected wind satisfies at least one of a plurality of predetermined criteria corresponding to an effect on the elevator system, and provide an indication of at least one of the satisfied criteria and the effect on the elevator system, wherein the predetermined criteria comprise a first wind speed threshold, a second wind speed threshold and a third wind speed threshold;

the second wind speed threshold is higher than the first wind speed threshold;

the third wind speed threshold is higher than the second wind speed threshold; and the processor is configured to determine whether a magnitude of a speed of the detected wind exceeds any of the thresholds.

20. The elevator system monitoring assembly of claim 19, wherein the processor indication comprises a first indication that the wind condition requires attention when the magnitude of the speed of the detected wind exceeds the first wind speed threshold, a second indication that the wind condition requires slowing down the elevator system when the magnitude of the speed of the detected wind exceeds the second wind speed threshold, and a third indication that the wind condition requires at least temporarily shutting down the elevator system when the magnitude of the speed of the detected wind exceeds the third wind speed threshold.

* * * * *